US005296780A

United States Patent [19]

Haraden et al.

[11] Patent Number: 5,296,780

[45] Date of Patent: Mar. 22, 1994

[54] ARC DISCHARGE LAMP HAVING CEMENTLESS RIGHT-ANGLE BASE MEMBERS

[75] Inventors: Thomas Haraden, S. Hamilton; Harold L. Hough, Beverly, both of Mass.

[73] Assignee: GTE Products Corporation, Danvers, Mass.

[21] Appl. No.: 854,185

[22] Filed: Mar. 20, 1992

[51] Int. Cl.[5] ..... H01J 5/48; H01J 5/50

[52] U.S. Cl. ..... 313/318; 313/493; 439/612; 439/619; 439/702

[58] Field of Search ..... 313/51, 318, 493; 439/611, 612, 616, 619, 702, 703, 704, 705, 706, 707

[56] References Cited

U.S. PATENT DOCUMENTS

| | | | |
|---|---|---|---|
| 2,716,738 | 8/1955 | Piotey | 313/318 |
| 2,716,739 | 8/1955 | Lemmers | 313/51 |
| 4,603,278 | 7/1986 | Devir et al. | 313/318 |
| 4,752,710 | 6/1988 | Devir et al. | 313/318 |
| 4,906,891 | 3/1990 | Takagi et al. | 313/318 |
| 5,116,272 | 5/1992 | Blaisdell et al. | 345/26 |
| 5,142,191 | 8/1992 | Blaisdell et al. | 313/488 |
| 5,210,461 | 5/1993 | Pai et al. | 313/493 |

FOREIGN PATENT DOCUMENTS

| | | | |
|---|---|---|---|
| 0281079 | 3/1988 | European Pat. Off. | H01J 5/56 |

*Primary Examiner*—Donald J. Yusko
*Assistant Examiner*—N. D. Patel
*Attorney, Agent, or Firm*—Carlo S. Bessone

[57] ABSTRACT

An arc discharge lamp including a two-piece base member having a main housing and a cap disposed at opposite ends of the lamp envelope. The main housing of the base member includes elongated slots to enable the housing to expand outwardly in response to positioning of the press seal. At least one internally-protruding segment formed in the housing is positioned within a detent formed in the press seal region of the lamp. Following positioning of the press seal, the cap is secured to the main housing. The base member is thus secured to the ends of the lamp envelope without the need for basing cements or the like.

10 Claims, 3 Drawing Sheets

ARC DISCHARGE LAMP HAVING CEMENTLESS RIGHT-ANGLE BASE MEMBERS

CROSS-REFERENCE TO RELATED APPLICATIONS

This application, which discloses and claims structural features for a low-pressure arc discharge lamp, relates to subject matter disclosed and claimed in the following copending applications, which are assigned to the assignee of the present application and are hereby incorporated by reference:

U.S. Pat. No. 5,210,461 to of Robert Y. Pai et al filed Feb. 18, 1992 and entitled "ARC DISCHARGE LAMP CONTAINING MECHANISM FOR EXTINGUISHING ARC AT END-OF-LIFE", U.S. Ser. No. 07/837,792 of Thomas Haraden et al filed Feb. 18, 1992 and entitled "ARC DISCHARGE LAMP HAVING CEMENTLESS BASE MEMBERS", U.S. Pat. No. 5,142,191 to of Ronald G. Blaisdell et al filed Jul. 3, 1990 and entitled "METHOD AND APPARATUS FOR FORMING APERTURES IN FLUORESCENT LAMPS", and U.S. Pat. No. 5,116,272 to Ronald G. Blaisdell et al filed Jul. 3, 1990 and entitled "APERTURE FLUORESCENT LAMP WITH PRESS SEAL CONFIGURATION".

FIELD OF THE INVENTION

This invention relates to the field of low-pressure arc discharge lamps. More particularly, the invention relates to low-pressure arc discharge lamps, such as subminiature fluorescent lamps, having base members that do not require affixing cements.

BACKGROUND OF THE INVENTION

Fluorescent lamps are well known and are used as a light source for various types of office automation equipment as well as for general lighting purposes and as a backlighting source for liquid crystal display units. Recently, there has been demands for miniaturization or increased effective luminescent length of these light sources. Due to limitations in space available for various applications, it is desired to reduce the size of the lamp or increase the effective luminescent length when the length of the lamp is not changed.

Conventionally, in low pressure discharge lamps of this type, that is, straight fluorescent lamps for example, the bi-pin type bases, which each have a couple of terminal pins extending in the axial direction of the bulb, are used as the bases attached to the ends of the bulb. Since the bases each have a couple of terminal pins protruding in the axial direction of the bulb, the entire length including the terminal pins is long. In addition, lamp sockets need to provide for the axial ends of the lamps in a manner that the lamp sockets are placed against the bases. As a result, the whole lighting equipment including the lamp sockets has to be large.

European Patent Application No. 0 281 079 discloses a low pressure discharge lamp having a pair of bases attached to opposite ends. Each base has a cylindrical base body into which the end of the bulb is inserted. The base is firmly secured to the bulb by an adhesive supplied between the end of the bulb and the inner surface of the base body. A pair of receiving terminals protrude from the base body in a direction perpendicular to the axis of the bulb.

U.S. Pat. No. 4,906,891 which issued to Takagi et al on Mar. 6, 1990, discloses a low pressure discharge lamp having a pair of bases fastened to the end of the bulb by injecting an adhesive into the gap between the bulb and the bottom wall of the base body. Each base member has a pair of terminals containing contact portions which project from the periphery of the base body and include contact surfaces extending parallel to the axis of the bulb and facing the same direction. The contact surfaces are located so as to contact a common plane.

Although the above-described lamp bases have been employed with varying degrees of success, it has been found that certain disadvantages do exist and such bases do leave something to be desired. More specifically, it has been found that such bases of the prior art require the use of an adhesive or the like to fasten the base to the lamp bulb. Moreover, some of the base/socket arrangements disclosed by the prior art do not accommodate for differences in the overall length of the lamp and/or leave a portion of the base terminals exposed when inserted in a socket and therefore may present a shock hazard.

SUMMARY OF THE INVENTION

It is, therefore, an object of the present invention to obviate the disadvantages of the prior art.

It is another object of the invention to provide an improved arc discharge lamp.

It is a further object of the invention to provide an arc discharge lamp containing base members securely positioned at opposite ends of the lamp without the need for basing adhesives or the like.

It is still another object of the invention to provide a base/socket arrangement that will accommodate for differences in the overall length of the lamp.

It is yet another object of the invention to provide an arc discharge lamp having base members that do not leave a portion of the base terminals exposed when the base member is inserted in a socket.

These objects are accomplished in one aspect of the invention by the provision of an arc discharge lamp comprising a light-transmissive envelope having a tubular-shaped main body and a press seal disposed at each end of the main body and including at least one detent formed therein. The main body of the envelope contains a fill material for supporting a low pressure discharge. A layer of phosphor is disposed on a surface within the main body of the envelope and an electrode filament is located in each end of the main body of the envelope. A pair of electrical leads are attached to each electrode filament and are sealed within a respective press seal. An insulative two-piece base member is disposed at each end of the envelope and includes a main housing and a cap. The main body has a tubular-shaped first portion and a second portion protruding perpendicularly from one end of the first portion and defining a cavity therewithin. The base member has a pair of terminals supported on opposite surfaces thereof. One end of the first portion defines a first opening therein for receiving a press seal and has at least one protruding segment within the first opening positioned within at least one detent formed in the press seal when the press seal is positioned within the first portion. The other end of the first portion of the main housing defines an annular-shaped second opening for receiving a portion of the main body of the envelope adjoining the press seal. The first portion of the main housing includes flexure means therein for enabling the sidewalls of the first portion to expand outwardly during positioning of the press seal within the first portion of the main housing. The base member further includes means for securing the cap to the main housing.

In accordance with further teachings of the invention, one end of the first portion of the main body includes a pair of protuberances extending from one end thereof and having a surface that forms a friction or close fit with an internal surface of the cap to prevent said first portion from spreading apart.

In accordance with further aspects of the present invention, the means for securing the cap to the main housing includes a latch formed on the cap and a latch lug formed on an inside surface of the second portion.

In accordance with still other teachings of the present invention, the cap includes a tongue protruding therefrom for forcing a free end of the pair of electrical leads into the cavity of the second portion during securement of the cap to the main housing.

In accordance with still further teachings of the present invention, the second portion of the main body includes a tongue protruding externally therefrom and having a cutout formed therein.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
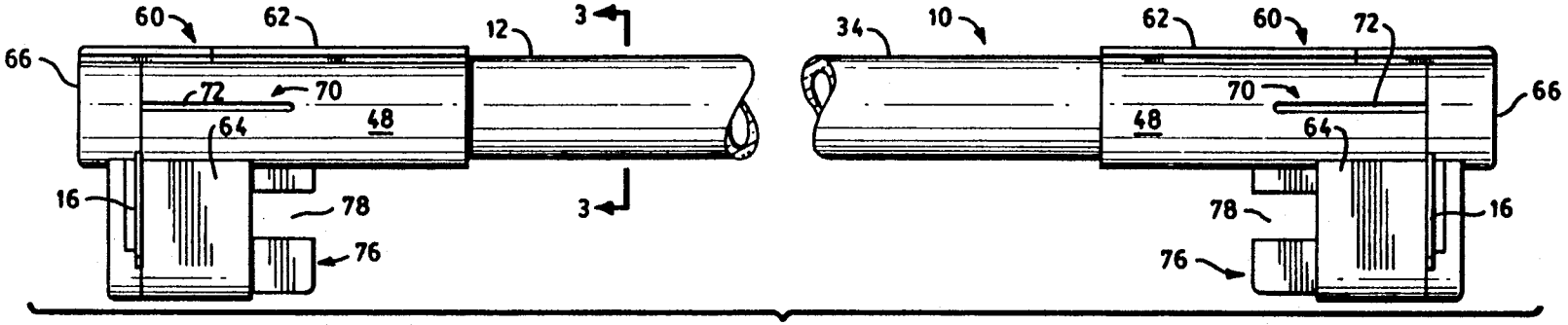
FIG. 1 is a plan view of an arc discharge lamp in accordance with the present invention.
Figure 3:
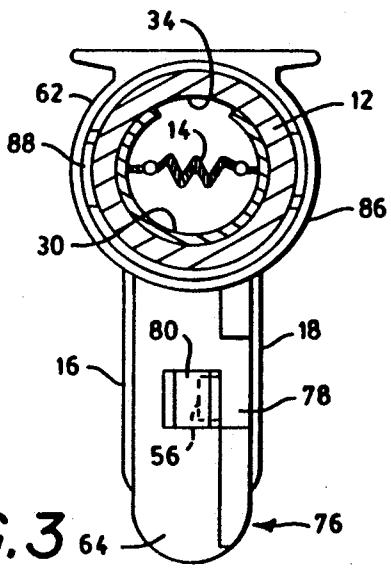
FIG. 3 is a cross-sectional view of the arc discharge lamp of FIG. 1 taken along the lines 3—3 of FIG. 1.
Figure 2:
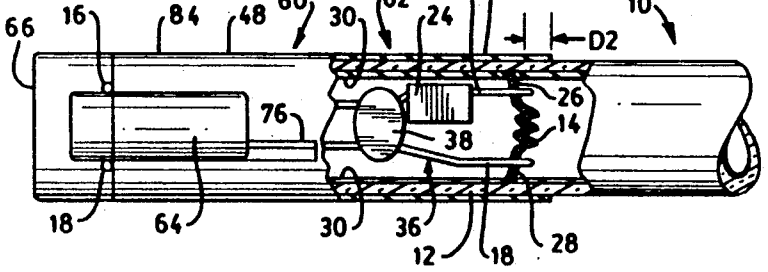
FIG. 2 is a partial view, partially in cross section, of one end of the arc discharge lamp of FIG. 1 rotated 90 degrees.

With particular attention to FIGS. 1–3, there is illustrated an improved low-pressure arc discharge lamp 10 (i.e., a fluorescent lamp) in accordance with the teachings of the invention. Lamp 10 generally includes a tubular-shaped light-transmissive envelope 12 having a tubular-shaped main body. Envelope 12 is typically fabricated of soda lime glass and, by the way of example, can have an outside diameter on the order of about 0.18 inch to 0.27 inch and a length in the range of 4–20 inches. An electrode filament 14 is mounted in each end of envelope 12. Electrical leads 16 and 18 are connected to filament 14 and extend through a press seal 20 (FIGS. 5 and 6) which includes a tubulation 40 generally positioned on an axis 42 of envelope 12. A glass bead 38 formed on electrical leads 16 and 18 insures that a predetermined separation between the electrical leads is maintained during formation of the press seal. The opposite end of the lamp 10 is constructed in a similar manner. A mercury dispenser 24 at one end of the lamp is attached to electrical lead 16. The lamp 10 contains a fill material including mercury supplied from dispenser 24 and a rare gas such as argon at a low pressure (e.g., 5 torr).

As illustrated in FIGS. 2 and 3, a coating 30 is applied to the inside surface of envelope 12. Lamp 10 may include an aperture 34 which is formed in layer 30 to direct light from lamp 10 in a preferred direction. As best shown in FIG. 1, the aperture 34 extends axially along a major portion of length of envelope 12 and has a uniform width. The width of aperture 34 depends on the desired radiation pattern from lamp 10. In the case of an aperture fluorescent lamp, layer 30 comprises a reflective layer and a phosphor layer. The reflective layer is first applied to the inside surface of envelope 12 and then the phosphor layer is applied over the reflective layer. The reflective layer has a reflective inside surface. The reflective layer insures that light emitted from the lamp 10 is directed through aperture 34, In an alternative configuration, the reflective layer is removed in aperture 34 but a phosphor layer is applied to the entire inner surface of envelope 12.

In another alternative, aperture 34 and the reflective layer are omitted. In this case, the phosphor layer is uniformly applied to the inside surface of envelope 12, and the lamp provides a uniform cylindrical radiation pattern.

A preferred technique for scraping aperture 34 is described in detail in U.S. Pat. No. 5,116,272 and assigned to the assignee of the present application.

The portion of each electrode filament 14 located between electrical leads 16 and 18 is coated with a quantity of electron-emissive material in order to lower the work function of the cathode and thus improve lamp efficiency. At the end of the useful life of the lamp, the electron-emissive material on one of the electrode filaments becomes depleted causing the cathode fall voltage to rise by 100 volts or more. If the external circuitry fails to limit the open circuit voltage across the lamp, the lamp may continue to operate with the additional power being applied at the lamp cathode region. This extra power can lead to excessive local heating of the lamp and fixture.

In accordance with the teachings of U.S. Pat. No. 5,210,416, as shown in FIG. 2 each electrode filament 14 is provided with a pair of ends 26 and 28, which extend toward and are in a contiguous relationship with an inside surface of the main body of envelope 12. During normal operation, the heating of electrode filament 14 is confined to those regions of the electrode filament located between electrical leads 16 and 18. Accordingly, little heat is conducted to the glass wall and operation of lamp 10 is unaffected.

It has been discovered that at end-of-life, the heating of an electrode filament depleted of electron-emissive material increases by up to a factor of ten and extends uniformly to the coil ends beyond electrical leads 16 and 18. As a result, a localized hot spot is produced on the glass wall where the electrode filament end touches. This localized heating causes a puncture in the lamp envelope and evacuation of the lamp. The introduction of the external atmosphere into the lamp extinguishes the arc discharge and renders the lamp inoperable.

Figure 4:
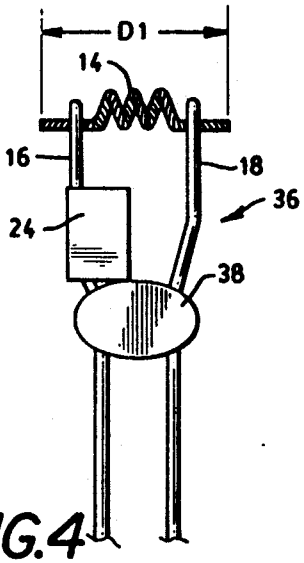
FIG. 4 is a plan view of a mount structure for use in the arc discharge lamp of FIG. 1.

FIG. 4 illustrates a mount 36 used in fabricating lamp 10. Mount 36 includes filament 14 supported by electrical leads 16 and 18 which are maintained separated by a conventionally-known glass bead 38. A mercury dispenser 24 is shown secured to electrical lead 16. It is understood that if a dispenser is employed as a means of introducing mercury into the lamp, only one dispenser is required per lamp.

In order to insure that ends 26 and 28 of electrode filament 14 firmly contact the inside surface of envelope 12, the axial length D1 (FIG. 4) of electrode filament 14 is slightly greater than the internal diameter of envelope 12. In a typical example, a subminiature fluorescent lamp having an envelope with an internal diameter of about 5 mm, would typically have a length D1 equal to about 7 mm.

Lamp 10 further includes an insulative base member 60 disposed at each end of lamp envelope 12. Base member 60 is of a two-piece construction and includes a main housing 48 including a first portion 62 having a tubular outer shape and a second portion 64 having a flattened shape protruding perpendicularly from first portion 62 and intended for insertion within an appropriate socket. The second piece of base member 60 consists of a cap 66 secured (e.g., snap fitted) to one end of main housing 48.

Figure 5:
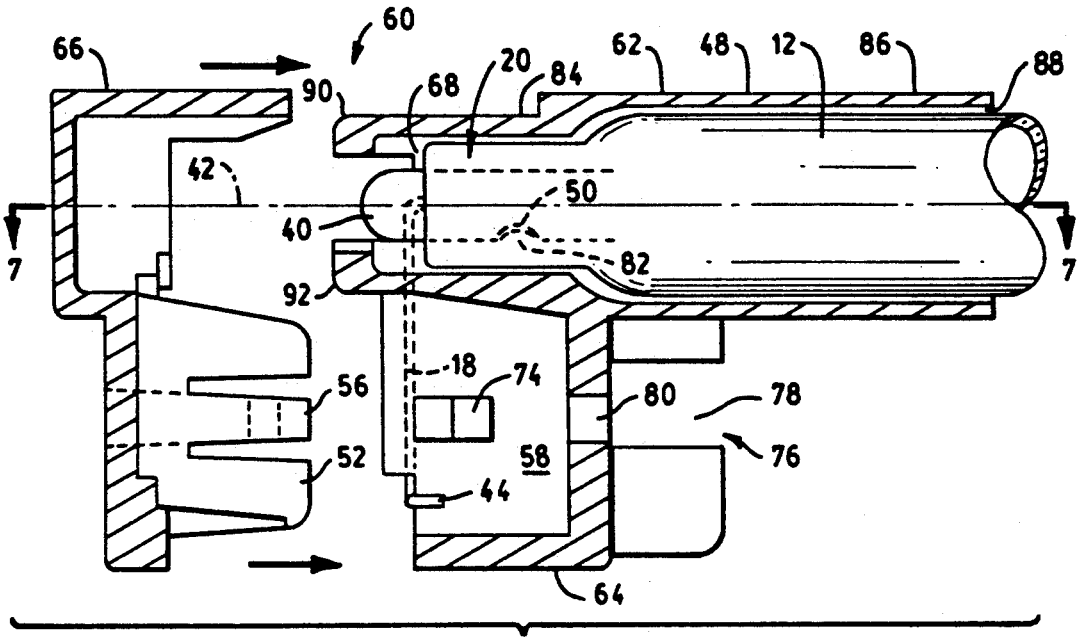
FIG. 5 is an exploded view, partially in cross section, of one end of an arc discharge lamp showing the two-piece base member of the present invention.
Figure 6:
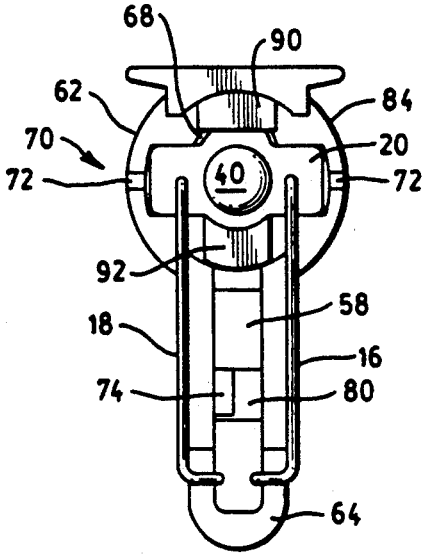
FIG. 6 is an end view of the arc discharge lamp of FIG. 5 with the cap of the base member completely removed from view.
Figure 7:
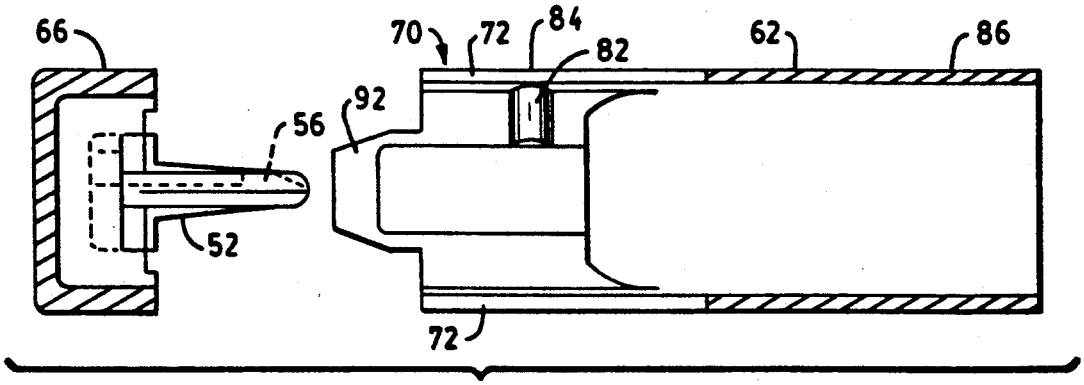
FIG. 7 is an exploded view, partially in cross section, of the two-piece base member taken along the line 7—7 in FIG. 5 without the lamp envelope.
Figure 8:
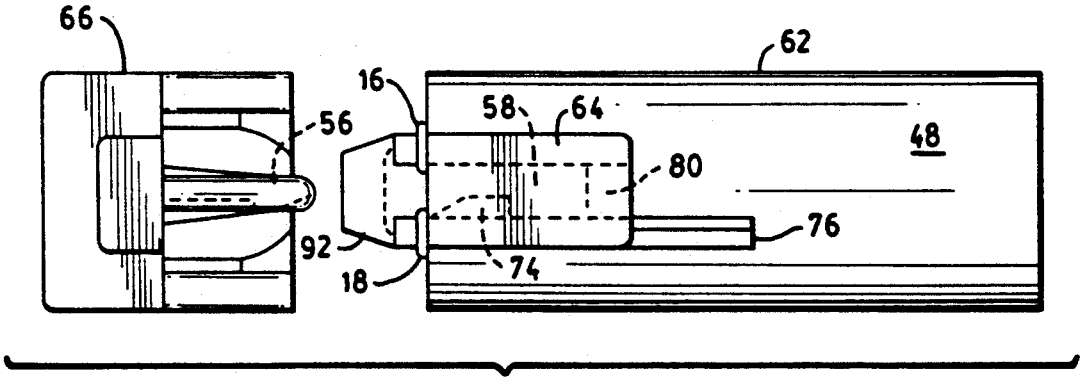
FIG. 8 is an exploded, bottom plan view of the two-piece base member.

Referring to FIGS. 5–7, one end 84 of first base member portion 62 defines therein an opening 68 which is designed for having press seal 20 securedly positioned therein. To assist in retaining the base member on envelope 12, at least one protruding segment 82 (FIG. 5), projects from an internal wall of first base member portion 62. Preferably two such segments are utilized and positioned in a diagonally-opposing relationship. Each of these protruding segments is designed for being aligned with and subsequently located within a corresponding recess or detent 50 formed in press seal 20. When one of the press seals of lamp 10 is inserted within first portion 62 of a respective base member 60, each of the protruding segments 82 is inserted within a corresponding detent 50, the result being that the press seal is partially retained in position To assure positive positioning without causing damage to the press seal, the first portion 62 of base member 60 further includes flexure means 70 therein as illustrated in FIGS. 1 and 7 to enable this part of the base member to expand a predetermined amount during said positioning. Flexure means 70 is preferably in the form of two elongated slots 72 formed within first portion 62 to thus enable first portion 62 to expand outwardly during positioning of the press seal within this portion of the base member.

The creation of a puncture in the lamp envelope at end of life as a result of electrode filament ends 26, 28 may, in some instances, result in fracture of the lamp envelope and loss of structural integrity. In this regard, the other end 86 of first portion 62 of the base member defines therein a circular opening 88. End 86 is designed to surround that portion of the lamp envelope adjacent electrode mount structure 36 and, preferably as shown in FIG. 2, to extend along the lamp axis and beyond the center of electrode filament 14 by a length D2. Typically, distance D2 is equal to about 3/16 inch (4.75 mm). Extending the first base member portion 62 provides support to the lamp envelope in the event that the envelope cracks in the area immediately adjacent the electrode filament ends 26 and 28.

Referring to FIGS. 5 and 6, after press seal 20 has been inserted within first portion 62 and partially retained by means of the insertion of each of the protruding segments 82 within a corresponding detent 50, electrical leads 16 and 18 are bent downward at right angles with respect to axis 42. Next, the lower end of electrical leads 16 and 18 are bent perpendicular to second portion 64 and toward each other. Finally, free end 44 (FIG. 5) of each electrical lead may be bent by hand into an internal cavity 58 formed by second portion 64 before cap 66 is secured to main housing 48. Preferably, as best shown in FIGS. 5 and 7, a tongue 52 extends from the lower portion of cap 66. During assembly of cap 66 to main housing 48, tongue 52 forces the free end 44 of each electrical lead 16, 18 into cavity 58.

As illustrated in FIGS. 5–8, first base member portion 62 includes a pair of protuberances 90, 92 extending from end 84. When the two pieces of the base member are assembled, the upper and lower surfaces of protuberances 90 and 92, respectively, form a friction or close fit with internal surfaces of the upper portion of cap 66. End 84 of first portion 62 is prevented from spreading apart and protruding segment 82 is thus locked in detent 50 of press seal 20. As a result, press seal 20 of the lamp envelope is firmly positioned and held within first portion 62 without the need for cement or the like.

Base member 60 is further provided with means for securing cap 66 to main housing 48 of base member 60. Preferably, cap 66 includes a latch 56 which mates with a latch lug 74 formed on an inside surface within cavity 58 of second portion 64. An aperture 80 formed in the wall of second portion 64 provides access for a tool used to form latch lug 74 during fabrication of the base member.

In order to retain each base member 60 of arc discharge lamp 10 within a socket, a keying rib 76 protrudes from second portion 64 and includes a latch cutout 78. Latch cutout 78 mates with a latch formed in the socket. Keying rib 76 may be located on the opposite side of the socket latch so as to differentiate between two lamp types, such as, hot or cold cathode.

Figure 9:
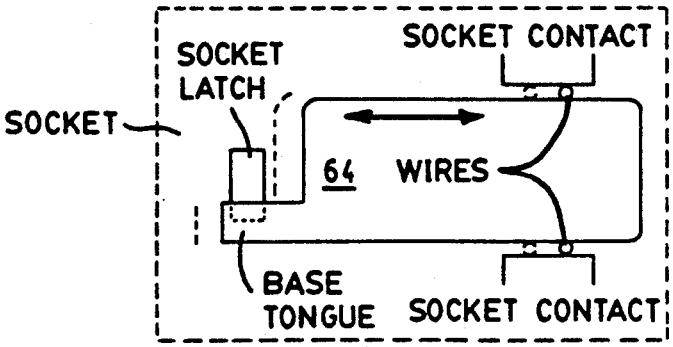
FIG. 9 is a schematic diagram of a socket for use with the base member of the present invention.

As illustrated in the socket diagram of FIG. 9, an external portion of each electrical lead or wire extends along opposite surfaces of the base member adjacent second portion 64 and provides a terminal for electrical connection to a respective contact disposed within the socket. Since second portion 64 of the base member is completely disposed within the socket, the electrical leads (or terminals) of the base member are not exposed and therefore do not present a shock hazard. FIG. 9 also illustrates that the proposed base/socket arrangement can accommodate differences in lamp length. In this regard, the solid lines illustrating the wire terminals and the base member in FIG. 9 represent the position within the socket of the base member on a maximum length lamp. The dashed lines illustrating the wire terminals and the left side of the base member represent the position of the base member on a minimum length lamp.

There has thus been shown and described an improved arc discharge lamp. The arc discharge lamp includes base members which are securely positioned at opposite ends of the lamp without the need for basing adhesives or the like. The base/socket arrangement will accommodate for differences in the overall length of the lamp. Also, the base members do not allow any portion of the base terminals to be exposed when inserted in a socket.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An arc discharge lamp comprising:

a light-transmissive envelope having a tubular-shaped main body and a press seal disposed at each end of said main body which includes at least one detent formed therein, said main body of said envelope containing a fill material for supporting a low pressure discharge;

a layer of phosphor disposed on a surface within said main body of said envelope;

an electrode filament located in each end of said main body;

a pair of electrical leads attached to each electrode filament and sealed within a respective press seal; and an insulative two-piece base member disposed at each end of said envelope and including a main housing and a cap, said main housing having a tubular-shaped first portion and a second portion protruding perpendicularly from one end of said first portion and defining a cavity therewithin, said base member having a pair of terminals supported on opposite surfaces thereof, said one end of said first portion defining a first opening therein for receiving said press seal and having at least one protruding segment within said first opening positioned within said at least one detent of said press seal when said press seal is positioned within said first portion, the other end of said first portion of said main housing defining an annular-shaped second opening for receiving a portion of said main body of said envelope adjoining said press seal, said first portion of said main housing including flexure means therein for enabling the sidewalls of said first portion to expand outwardly during positioning of said press seal within said first portion of said main housing, said base member including means for securing said cap to said main housing.

2. The arc discharge lamp of claim 1 wherein said first portion of said main body includes a pair of protuberances extending from one end thereof and having a surface that forms a friction or close fit with an internal surface of said cap to prevent said first portion from spreading apart.

3. The arc discharge lamp of claim 1 wherein said means for securing said cap to said main housing includes a latch formed on said cap and a latch lug formed on an inside surface of said second portion.

4. The arc discharge lamp of claim 1 wherein said cap includes a tongue protruding therefrom for forcing a free end of said pair of electrical leads into said cavity of said second portion during securement of said cap to said main housing.

5. The arc discharge lamp of claim 1 wherein said second portion of said main body includes a keying rib protruding externally therefrom and having a cutout formed therein.

6. A two-piece base member for an arc discharge lamp including a pair of electrical leads supporting an electrode filament and sealed within a press seal disposed at each end of an envelope having a main body, each said press seal having at least one detent formed therein, said base member comprising:

a main housing and a cap, said main housing having a tubular-shaped first portion and a second portion protruding perpendicularly from one end of said first portion and defining a cavity therewithin, said base member having a pair of terminals supported on opposite surfaces thereof, said one end of said first portion defining a first opening therein for receiving said press seal and having at least one protruding segment within said first opening positioned within said at least one detent of said press seal when said press seal is positioned within said first portion, the other end of said first portion of said main housing defining an annular-shaped second opening for receiving a portion of said main body of said envelope adjoining said press seal, said first portion of said main housing including flexure means therein for enabling the sidewalls of said first portion to expand outwardly during positioning of said press seal within said first portion of said main housing, said base member including means for securing said cap to said main housing.

7. The base member of claim 6 wherein said first portion of said main body includes a pair of protuberances extending from one end thereof and having a surface that forms a friction or close fit with an internal surface of said cap to prevent said first portion from spreading apart.

8. The base member of claim 6 wherein said means for securing said cap to said main housing includes a latch formed on said cap and a latch lug formed on an inside surface of said second portion.

9. The base member of claim 6 wherein said cap includes a tongue protruding therefrom for forcing a free end of said pair of electrical leads into said cavity of said second portion during securement of said cap to said main housing.

10. The base member of claim 6 wherein said second portion of said main body includes a keying rib protruding externally therefrom and having a cutout formed therein.

* * * * *